US006247252B1

(12) United States Patent
Parisotto

(10) Patent No.: US 6,247,252 B1
(45) Date of Patent: Jun. 19, 2001

(54) SKI BOOT

(75) Inventor: Davide Parisotto, Casella D'Asolo (IT)

(73) Assignee: Calzaturificio S.C.A.R.P.A. S.p.A. (IT)

( * ) Notice: Subject to any disclaimer, the term of this patent is extended or adjusted under 35 U.S.C. 154(b) by 0 days.

(21) Appl. No.: 09/490,691

(22) Filed: Jan. 24, 2000

(30) Foreign Application Priority Data

Jan. 26, 1999 (IT) ..... TO99A0055

(51) Int. Cl.[7] ..... A43B 5/04
(52) U.S. Cl. ..... 36/118.7; 36/117.2; 36/118.2
(58) Field of Search ..... 36/117.2, 118.2, 36/118.8, 118.7, 117.4

(56) References Cited

U.S. PATENT DOCUMENTS 3,972,134 8/1976 Kastinger ..... 36/118
4,505,056 * 3/1985 Beneteau .
4,677,769 * 7/1987 Ahmad et al. .
5,031,341 * 7/1991 Paris et al. .
5,446,976 * 9/1995 Donnadieu et al. .
5,499,461 3/1996 Danezin et al. ..... 36/117
5,664,344 * 9/1997 Marmonier .
5,675,917 10/1997 Falguere et al. ..... 36/117.2
5,884,420 * 3/1999 Donnadieu .
6,012,237 * 1/2000 Okajima et al. .
6,076,285 * 6/2000 Caeran et al. .

* cited by examiner

*Primary Examiner*—Ted Kavanaugh
(74) *Attorney, Agent, or Firm*—Ladas and Parry

(57) ABSTRACT

A telemark ski boot including a shell of plastic material and a sole is provided. The shell is provided with a pair of lateral walls and a flexible portion extending transversely to the shell in the metatarsus area from one side to the other of the sole. The shell includes a pair of stiffening elements which extend along respective lateral walls between an intermediate portion of the sole in proximity with the flexible portion and a rear portion of the shell.

6 Claims, 2 Drawing Sheets

SKI BOOT

The present invention refers to a ski boot, in particular for telemark skiing.

BACKGROUND OF THE INVENTION

As is known the telemark technique requires the use of ski boots which are flexible in the area of the metatarsus, since the curves are made in a "free" heel fashion, in other words with the heel raised from the ski rather than rigidly fixed to the ski fastening as in the conventional skiing technique.

Traditional telemark ski boots are made of leather, which makes it possible to obtain the necessary flexibility. In recent years the use of new generation telemark ski boots, made of plastic material, has become steadily more common, offering improved aesthetics with respect to the leather boots and greater strength and duration.

In order to allow flexibility in the area of the metatarsus, plastic boots generally have a flexible wall portion in this area. The flexibility is attained by a particular geometric configuration of the wall portion, typically corrugation or undulation, or by making this wall portion of the boot of a more flexible material with respect to the remainder of the boot. The use of plastic materials with different mechanical characteristics, in order to create parts of the boot with differing flexibility, is made possible by overinjection or co-injection.

The use of an increased flexibility area however could compromise the rigidity of the ski boot, in particular in torsion, and therefore diminish control of the skis and as a result performance and safety.

SUMMARY OF THE INVENTION

The aim of the present invention is to create a ski boot of plastic material, in particular for telemark skiing, which has good characteristics of torsional rigidity without penalising the flexibility in the area of the metatarsus.

The above mentioned aim is reached by a ski boot, in particular for telemark skiing, of the type including a shell of plastic material and a sole, said shell having lateral walls and a flexible portion extending transversely to said shell in the metatarsus area from one side to the other of said sole, characterised by including a pair of stiffening elements which extend along the respective said lateral walls of said shell between an intermediate portion of said sole and a rear area of said shell.

BRIEF DESCRIPTION OF THE DRAWINGS

In order to better understand the present invention a preferred embodiment is now described, by way of a non-limiting example and with reference to the appended drawings in which.

DETAILED DESCRIPTION OF THE INVENTION

Figure 1:
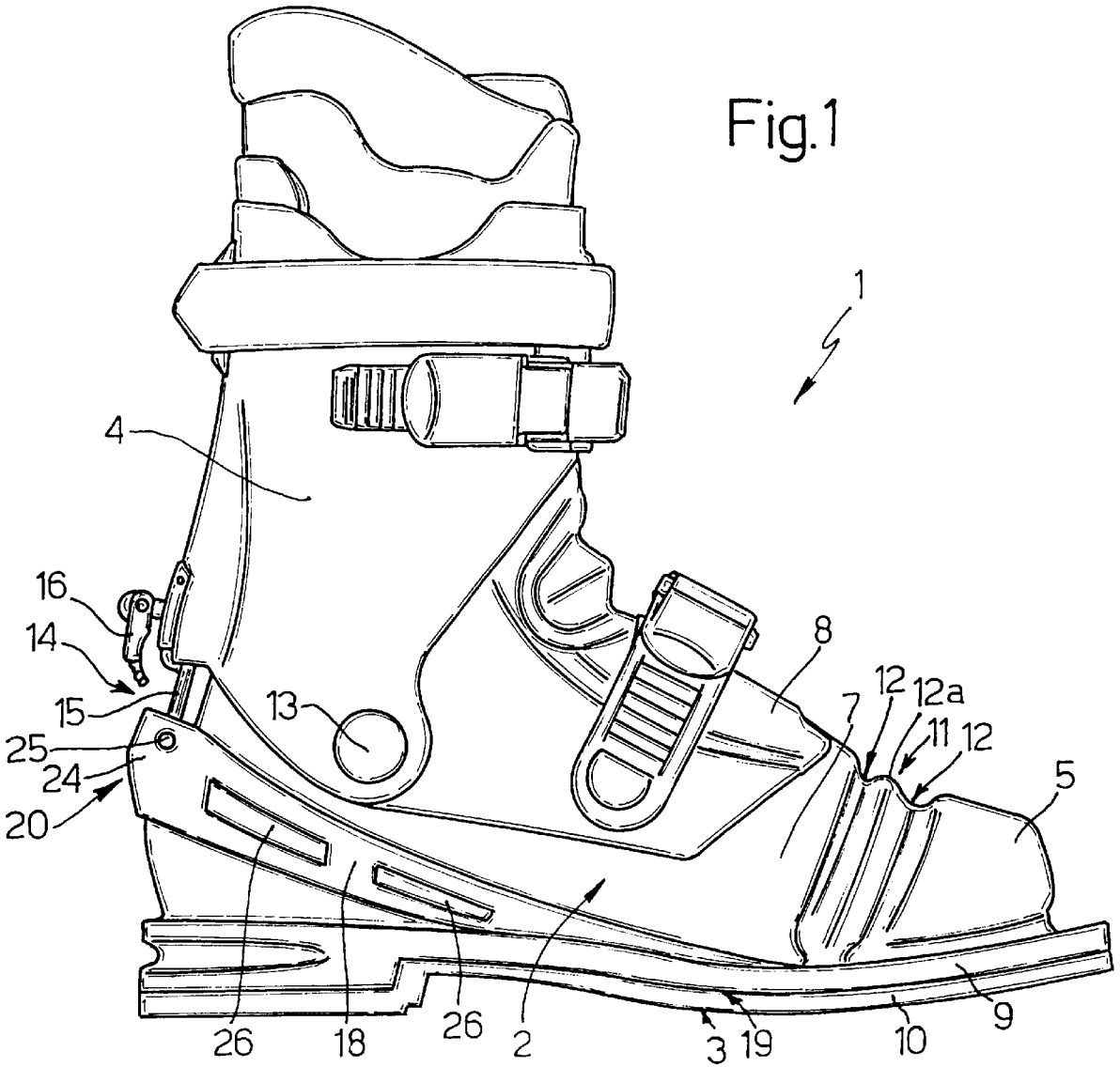
FIG. 1 is a side view from one side of a telemark ski boot according to the present invention.
Figure 3:
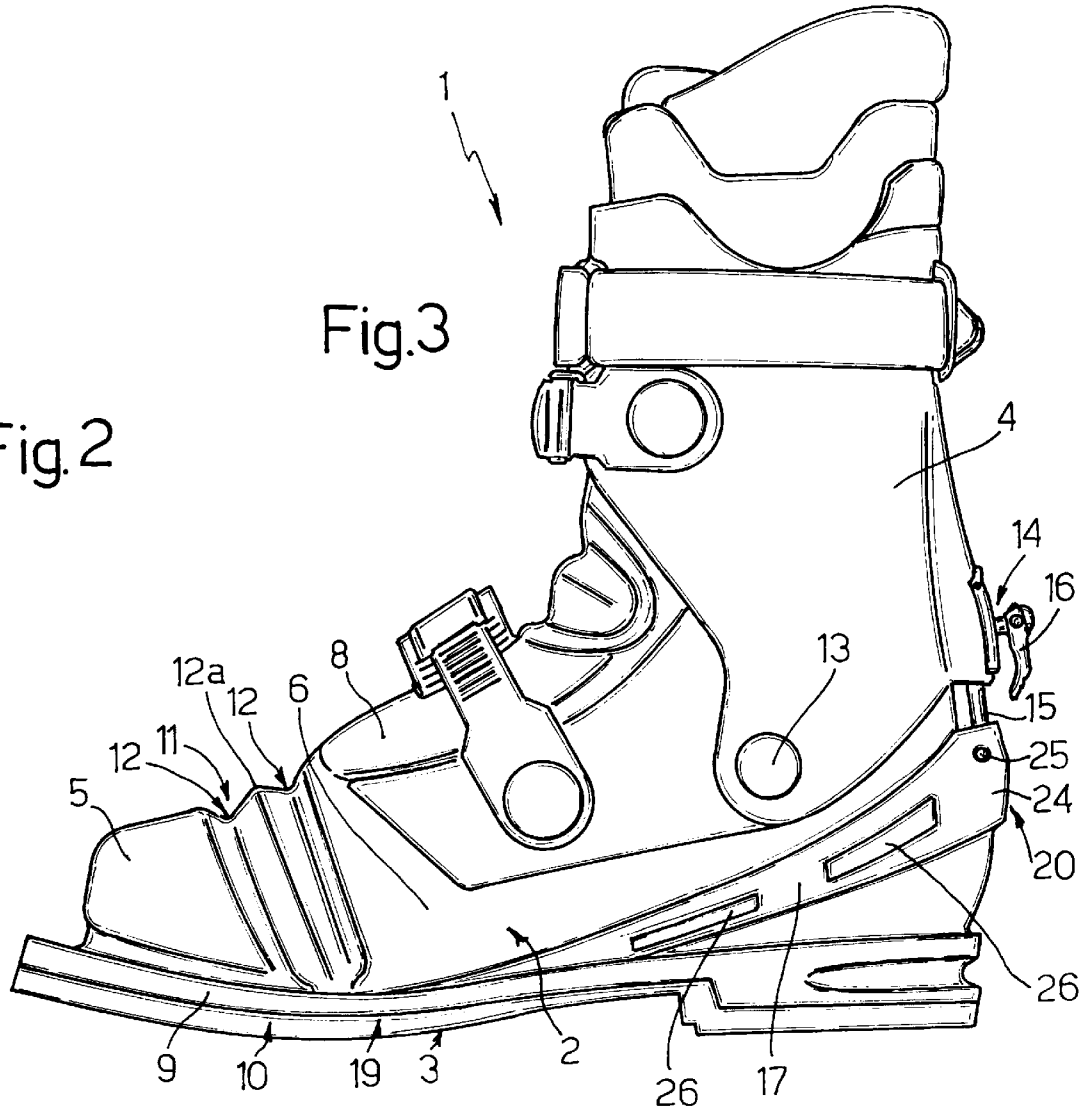
FIG. 3 is a side view, from the opposite side to that shown in FIG. 1.
Figure 2:
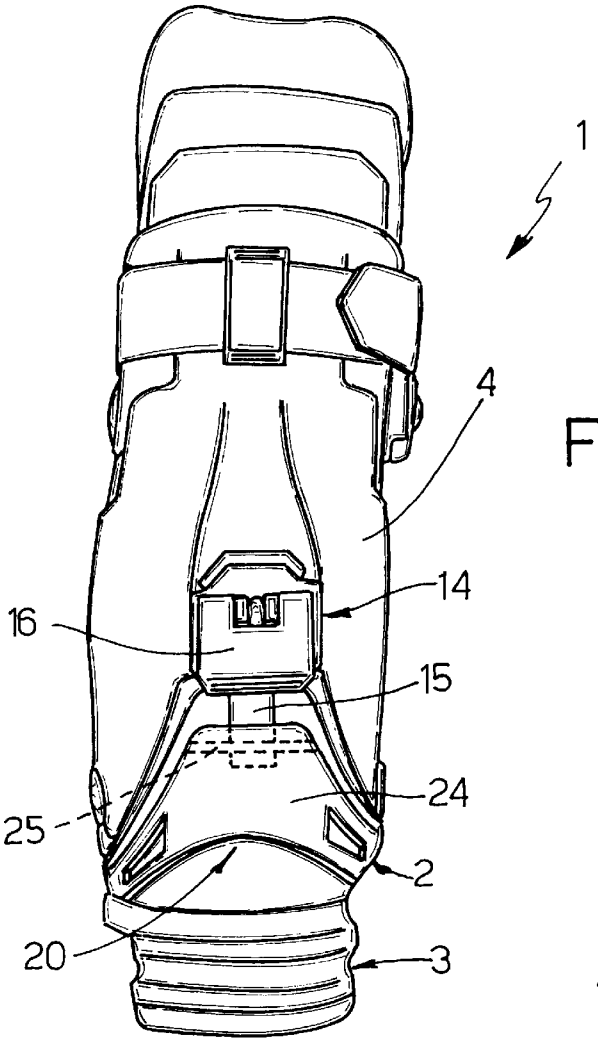
FIG. 2 is a rear view of the ski boot of FIG. 1.

With reference to the FIGS. 1 to 3, a ski boot, in particular for telemark skiing, is indicated as a whole by numeral 1.

Ski boot 1 essentially comprises a shell 2 of plastic material, a sole 3, and a leg piece 4 hinged to shell 2 at the ankle.

Shell 2 includes an integral toe portion 5, a pair of lateral walls 6, 7 forming together a front opening (not shown) closed by a tongue 8 of known type, and a bottom wall or inner sole 9 which closes the shell itself at the bottom. An external sole 10 made of elastomeric material is fixed on the lower part of the inner sole 9 and constitutes sole 3 therewith.

Shell 2 also has a flexible portion 11 which extends transversely with respect to the shell itself, from one side of sole 3 to the other, substantially in the metatarsus area. Said portion 11 presents an undulated profile defined by a pair of grooves 12 separated by an intermediate rib 12*a* with a rounded profile.

Leg piece 4 is joined to the respective lateral walls 6, 7 of shell 2 by respective hinges 13 positioned in correspondence with a transversal, ankle-articulation axis. Ski boot 1 also comprises a control device 14 for adjusting inclination of leg piece 4 with respect to shell 2, positioned at a rear portion 20 of the ski boot, substantially above the heel grip. Device 14, of known type, essentially comprises a blade 15 joined at its lower end to shell 2 and engaging in a sliding mode a seat (not shown) of leg piece 4, and a control lever 16 on the leg piece 4, which actuates a locking element (not shown) designed to co-operate selectively with blade 15 to lock the latter in the relative seat in a relative defined position.

According to the present invention, shell 2 has a pair of stiffening elements 17, 18 integrally formed on the respective lateral walls 6, 7 and essentially formed by respective raised, external ribs on lateral walls 6,7. Elements 17, 18 each extend from an intermediate area 19 of the sole 3 adjacent to flexible portion 11 to rear portion 20 of the ski boot, where they join to form a substantially continuous band which wraps shell 2.

More in particular, stiffening elements 17, 18 join inner sole 9 immediately behind flexible portion 11, so as to avoid compromising the flexibility of the ski boot 1 in correspondence with this portion; stiffening elements 17, 18 are inclined upwards toward rear portion 20 of ski boot 1, where they form a base 24 for anchoring tilt control device 14 of the leg piece 4, in which the lower end of blade 15 is housed and locked by means of a transverse pin 25 (FIG. 2).

Advantageously, in order to reduce the overall weight of ski boot 1, stiffening elements 17, 18 are equipped with lightening cavities 26.

By examining the characteristics of ski boot 1 according to the present invention, the advantages attained thereby will appear clearly. In particular, stiffening elements 17, 18 limit the torsional deformations of shell 2, improving control of the ski, without penalising the flexibility of the shell 2, in the area of portion 11. Thanks to the presence of said stiffening elements, lateral walls 6, 7 of shell 2 can be made with reduced thickness, contributing to an overall reduction in the weight of the ski boot 1. Finally, stiffening elements 17, 18 define the anchoring element 24 of the tilt control device 14, and therefore it is not necessary to provide the shell 2 with otherwise useless structures dedicated to this purpose, which would increase the weight of the ski boot and would be aesthetically unsatisfactory.

Finally, it is clear that alterations and variations may be made to the ski boot 1 described above without departing from the scope defined by the claims.

For example, stiffening elements 17, 18 may be made of a different material than shell 2 and coupled with it using any technique; in particular, they may be made of a different plastic materials than the shell, and integrally linked to it by co-injection. Alternatively, these stiffening elements may be secured to shell 2 removably.

What is claimed is:

1. A telemark ski boot comprising a shell (2) of plastic material and a sole (3), said shell (2) being provided with a pair of lateral walls (6,7) and a flexible portion (11) extending transversely to said shell in the metatarsus area from one side to the other of said sole (3) and integral to said lateral walls, said shell, including a pair of stiffening elements (17, 18) which extend along respective said lateral walls (6, 7) of said shell (2) between an intermediate portion (19) of said sole (3) and a rear portion (20) of said shell (2), said stiffening elements (17, 18) joining said sole (3) in proximity with said flexible portion (11), being inclined upwards proceeding from said sole (3) towards said rear portion (20) of said shell (2), and joining with each other in said rear portion (2) in order to form a continuous band which wraps said shell (2).

2. A telemark ski boot as claimed in claim 1, wherein said stiffening elements (17, 18) consist of raised, external ribs integral with said shell (2).

3. A telemark ski boot as claimed in claim 1, wherein said sole (3) includes an inner sole (9) which is part of said shell (2) and an outer sole (10) fixed below said inner sole (9), said stiffening elements (17, 18) being integral with and joined to said inner sole (9).

4. A telemark ski boot as claimed in claim 1, wherein including a leg piece (4) hinged on said shell (2) and a tilt control device (14) for said leg piece (4) with respect to said shell (2).

5. A telemark ski boot as claimed in claim 4, wherein said stiffening elements (17, 18) form an anchor base (24) in said rear area (20) of said shell (2) for said tilt control device (14) for the adjustment of the inclination of said leg piece (4).

6. A telemark ski boot as claimed in claim 1, wherein said stiffening elements (17, 18) have lightening cavities (26).

* * * * *